US005948585A

United States Patent [19]

Gady et al.

[11] Patent Number: 5,948,585

[45] Date of Patent: Sep. 7, 1999

[54] OPTIMIZED PARTICULATE SURFACE TREATMENT CONCENTRATION FOR ELECTROSTATOGRAPHIC IMAGES PRODUCED IN AN ELECTROSTATOGRAPHIC ENGINE THAT INCLUDES A COMPLIANT INTERMEDIATE TRANSFER MEMBER

[75] Inventors: Barrett L. Gady, Rochester; Donald S. Rimai, Webster; Peter S. Alexandrovich; Salvatore Leone, both of Rochester, all of N.Y.

[73] Assignee: Eastman Kodak Company, Rochester, N.Y.

[21] Appl. No.: 09/116,802

[22] Filed: Jul. 16, 1998

[51] Int. Cl.[6] ..... G03G 13/22

[52] U.S. Cl. ..... 430/126; 430/111

[58] Field of Search ..... 430/111, 126

[56] References Cited

U.S. PATENT DOCUMENTS 5,253,021 10/1993 Aslam et al. ..... 430/124
5,666,193 9/1997 Rimai et al. ..... 430/126
5,714,288 2/1998 Vreeland et al. ..... 430/126
5,715,505 2/1998 Tombs et al. ..... 399/299
5,715,509 2/1998 Staudenmayer et al. ..... 399/308
5,728,496 3/1998 Rimai et al. ..... 430/126
5,835,832 11/1998 Rimai et al. ..... 430/109

*Primary Examiner*—Roland Martin
*Attorney, Agent, or Firm*—Norman Rushefsky

[57] ABSTRACT

A method of producing images includes forming an electrostatic latent image on a primary image forming member. A toner image is developed on the primary image forming member using a developer comprising dry toner particles having a mean volume weighted diameter D between 5 $\mu$m and 10 $\mu$m. The toner particles contain particulate addenda in a concentration range between (3.2/D)% and (5.6/D)%. The toner image is electrostatically transferred from the primary image forming member to an intermediate transfer member having a compliant layer, and then electrostatically transferred from the intermediate transfer member to a receiver.

21 Claims, 7 Drawing Sheets

OPTIMIZED PARTICULATE SURFACE TREATMENT CONCENTRATION FOR ELECTROSTATOGRAPHIC IMAGES PRODUCED IN AN ELECTROSTATOGRAPHIC ENGINE THAT INCLUDES A COMPLIANT INTERMEDIATE TRANSFER MEMBER

FIELD OF THE INVENTION

This invention relates to the field of electrostatography in general and to electrography and electrophotography in particular. More specifically, this invention relates to a method of producing high quality electrostatographic images using small dry toner particles and an engine that includes a compliant intermediate transfer member.

BACKGROUND OF THE INVENTION

An electrostatographic image is produced by generating an electrostatic latent image on a primary image forming member. A visible image is then produced by bringing the electrostatic latent image into close proximity to an appropriate developer. The image is then transferred to a receiver and permanently fixed to that receiver by a suitable process such as fusing. If the electrostatographic process is electrophotographic, the primary image forming member comprises a photoconductive member. The photoconductive member is initially uniformly charged. The electrostatic latent image is produced by image-wise exposing the charged photoconductive member to an exposure source such as an optical exposure means, LED array, laser-scanner, or other electro-optical exposure device. The latent image is then developed by bringing the latent-image bearing photoconductive member into close proximity to an appropriate developer comprising electrically charged marking or toner particles. The image is then transferred from the photoconductor to an appropriate receiver such as paper or transparency stock. Although transfer can be effected using a variety of means, it is generally accomplished by applying an electrostatic potential to urge the toner particles from the photoconductive member to the receiver. Alternatively, the image can be transferred first to an intermediate member and subsequently to the receiver. The image is then permanently fixed to the receiver using suitable means such as applying heat and pressure to melt the toner in a process known as fusing. The photoconducting member is then cleaned and made ready to produce subsequent images.

It is well known that the adhesive and cohesive properties of toner particles affect transfer. The term, "adhesive", refers to attractive forces between particles and a receiver surface. The term, "cohesive", refers to attractive forces between similar particles. Specifically, as the toner diameter decreases, the forces holding the toner particles to surfaces such as the primary imaging member start to dominate over the electrostatically applied transfer force. For all practical purposes, this occurs for toner particles without particulate addenda when the toner diameter is less than approximately 12 $\mu$m (micrometers).

There have been numerous methods employed to facilitate toner transfer for toner particles having diameters less than 12 $\mu$m. For example, toned images have been transferred thermally. However, this often requires specific receivers and can be harsh on the primary imaging members, especially photoconductors. Release agents such as zinc stearate have been applied to primary imaging members. However, these often interact with the charging properties of the toner particles in undesirable fashions. Moreover, they do not last on the primary imaging member and need to be replenished. This often requires complex subsystems and process control. In another method of reducing toner adhesion to the primary imaging member, the surface of the toner is coated with sub-micrometer particulate addenda such as silica particles. These addenda often do not form a uniform coating on the toner particles, but, rather, agglomerate into clusters having cluster diameters in the range of tens of nanometers, as determined using scanning electron microscopy (SEM). Using this technology, it has been possible to reduce the volume weighted toner diameter, wherein the adhesion forces holding the toner to the primary imaging member dominate over the applied electrostatic transfer force, from approximately 12 $\mu$m to approximately 8.5 $\mu$m. However, it is unlikely that a further decrease in toner size using this technology alone would be feasible.

In another method of electrostatically transferring toner particles, Rimai and Chowdry in U. S. Pat. No. 4,737,433 have shown that, by using monodisperse, spherical toner particles and smooth receivers, it is possible to balance the surface forces, thereby permitting electrostatic transfer of toner particles having diameters as little as 2 $\mu$m. However, particulate contaminants such as dust, carrier particles, etc. separate the receiver from the primary image forming member, thereby creating artifacts in the image. Moreover, the requirement that one use very smooth receivers limits the utility of this technique.

Another method of transfer employs the use of a compliant intermediate transfer member. In this method of transfer, the toned image is first transferred from the primary image forming member to the compliant intermediate. The image is subsequently transferred from the intermediate to the receiver. In a preferred mode of operation and with reference to International Published Application WO 98/04961, color images are produced by transferring the toned color separation images from the primary image forming member to the compliant intermediate in register and then transferring the entire image to the receiver. In another preferred embodiment, the color separation images can be produced in separate respective color modules wherein each color separation image is transferred to a separate respective compliant intermediate. The images are then transferred sequentially from the respective intermediates, in register, to the receiver. In a less preferred embodiment, the various color separation images could be transferred sequentially to a single compliant intermediate member and alternately transferred in register to the final receiver surface.

The use of a compliant intermediate member may permit balancing of surface forces. Indeed, Zaretsky and Gomes (U.S. Pat. No. 5,370,961) have shown that it is possible to transfer images made with silica-coated toner particles having diameters of 3.5 $\mu$m using compliant intermediates.

It is often not desirable to use toner particles as small as those used by Zaretsky and Gomes because development rates decrease with decreasing toner size. Moreover, for many applications, such as in binary imaging, wherein the image consists of halftone dots, multibit level dots, alphanumerics, lines and text, etc., very small particles (i.e. those having diameters less than 5 $\mu$m) may not give substantial improvements in image quality. Nonetheless, it is often desirable to use toner particles having diameters less than 10 $\mu$m and even more desirable to use toner particles having diameters between 5 $\mu$m and 9 $\mu$m. To do so it is necessary to transfer such images with high efficiency but without significant degradation of the toned image.

Degradation in transfer often occurs because the electrostatically charged toner particles tend to repel each other.

However, cohesive forces between the particles tend to stabilize the toned image structure. However, as adhesion is decreased by the addition of the particulate addenda, cohesion is also reduced, thereby aggravating image disruption and resulting in toner particles forming satellites around the image. This causes objectionable background and results in other artifacts such as a loss of resolution and sharpness.

The reduction of cohesion between toner particles themselves can introduce new problems during transfer. As the images, comprised of collections of charged toner particles, are transferred to the receiver, the repulsive electrostatic forces between toner particles can cause the images to fly apart. This effect is most apparent in halftone dot images where the halftone dots literally can explode. While dot explosions can occur in non-treated toner systems, it has been observed that the use of submicrometer particulate addenda can aggravate the dot explosion problem, presumably by reducing the cohesion between toner particles and thereby accentuating the electrostatic repulsion between those particles. Alternatively, it is possible that when transfer is accomplished using an electrically biased transfer nip, dot explosion may be caused by transfer of some of the surface-treated toner particles and halftone dots across the air gap in the pre-nip region due to high electrostatic fields. Sufficiently large electrostatic fields produced in this pre-nip region, can destabilize the fragile dots that are held together by surface forces. The cohesive forces must overwhelm the electrostatic repulsion between the like sign charged toner particles in order to keep the dots from exploding. If transfer occurs only after the photoconductor is in physical contact with the receiver, the effects of dot explosion can be reduced since the toner particles, including those which might otherwise become satellites, will not be able to move very far from their intended location.

Improvement in transfer efficiency with minimal image disruption represents an important problem in the field of electrostatography.

SUMMARY OF THE INVENTION

The invention is directed to methods for providing improvements to transferring of images so that reduced image disruption results. Specifically, in accordance with a first aspect of the invention there is provided a method of producing images comprising, forming an electrostatic latent image on a primary image forming member, forming a toner image on the primary image forming member by developing the electrostatic latent image using a developer comprising dry toner particles having a mean volume weighted diameter D between 5 $\mu$m and 10 $\mu$m, the toner particles containing particulate addenda in a concentration range between (3.2/D)% and (5.6/D)%, electrostatically transferring the toner image from the primary image forming member to an intermediate transfer member having a compliant layer; and electrostatically transferring the toner image from the intermediate transfer member to a receiver.

In accordance with a second aspect of the invention there is provided a method of producing images comprising: forming on a primary image forming member a toner image with dry toner particles having a mean volume weighted diameter D between 5 $\mu$m and 10 $\mu$m , the toner particles containing particulate addenda in a concentration range between (3.2/D)% and (5.6/D)%; electrostatically transferring the toner image from the primary image forming member to an intermediate transfer member having a compliant layer; and electrostatically transferring the toner image from the intermediate transfer member to a receiver.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

Figure 1:
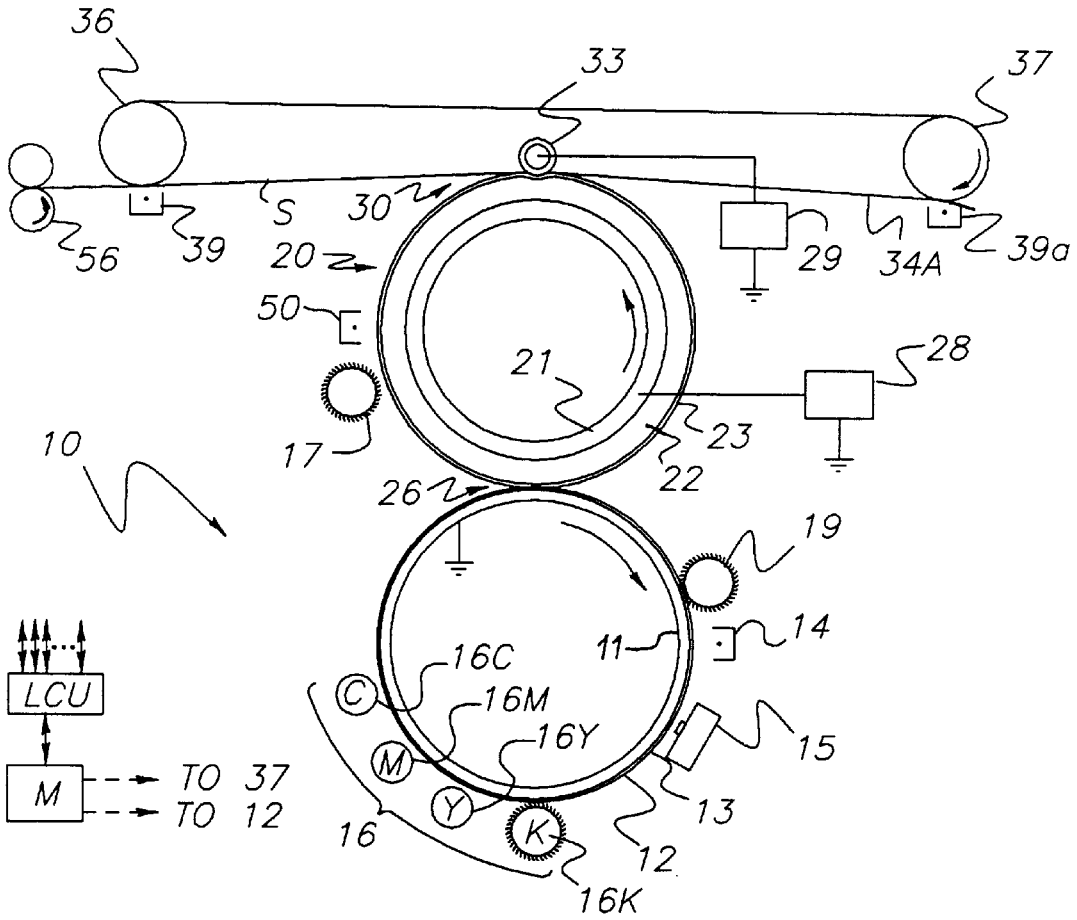
FIG. 1 is a side elevational view in schematic illustrating one preferred apparatus in which the invention may be used.

An electrostatographic apparatus, specifically an electrophotographic apparatus, is illustrated by FIG. 1. The image forming apparatus 10 includes a primary image forming member, for example, a photoconductive drum 11, upon which a series of varying color toner images may be created. In lieu of a drum a photoconductive belt may be used. More specifically, a surface 13 of a photoconducting layer or layers 12 is initially uniformly charged by a charging device such as a corona charging device 14. A roller or brush charger may also be used. The charged photoconductive member is image-wise exposed by an appropriate exposure source, for example, an LED array 15 to create electrostatic images. Other exposure sources such as laser or other electro-optical devices may be used. Optical exposure may also be used. A visible image is generated by bringing the photoconductive member into close proximity to a suitable developer provided at a development station area 16. To produce color images, toners having suitable colors are chosen. For example, in order to produce full-color images, the electrostatic images are developed with different colored toners black, yellow, magenta, and cyan, corresponding to the subtractive primary colors provided in respective color development stations 16K, 16Y, 16M and 16C. The invention is not limited to color apparatus and only one development station having toner of one color may be provided.

The separate color toner images are transferred, in register, to the outside surface of an intermediate transfer member (ITM), for example, a compliant intermediate drum 20 to form a composite multicolor toner image. Compliant intermediate transfer members are known, in this regard reference may be had to Zaretsky et al. U.S. Pat. No. 5,370,961. They may be in the form of a belt or a roller. As shown in FIG. 1, drum 20 includes a metallic conductive core 21 and a semiconductive thin blanket layer (between about 1 mm and 20 mm, more preferably about 10 mm) of polyurethane 22 doped with an appropriate amount of antistat to have a resistivity of between about $1\times10^7$ ohm-cm and about $1\times10^{11}$ ohm-cm and more preferably about $10^8$ ohm-cm. The compliant layer has a Young's modulus in the range of about 0.1 MPa to about 10 MPa, and more preferably between 1 MPa and 5 MPa. The surface of the intermediate member has a sufficiently hard and thin overcoat 23, for example, a thickness of between about 2 $\mu$m and about 30 $\mu$m and more preferably between 5 and 10 $\mu$m thick ceramer having a Young's modulus greater than 100 MPa, as measured by extending a bulk sample of the overcoat material in an Instron Tensile Tester, using standard techniques. Alternatively, if it is not feasible to form a free standing bulk sample of the overcoat material, its Young's modulus can be determined using a Hertzian indentor, as is well known in the literature. Examples of overcoat materials may be found in U.S. application Ser. No. 08/846,056 filed Apr. 25, 1997 in the name of Vreeland et al the contents of which are incorporate herein by reference. Examples of polyurethane semiconductive blanket materials are provided in Wilson et al. U.S. Pat. No. 5,212,032 the contents of which are incorporate herein by reference. The multicolored image is transferred at nip 26 to this compliant intermediate by applying a sufficient electrical potential, for example, 600 volts applied by a power source 28 connected to the conductive core 21.

The multicolored image formed on the compliant intermediate is transferred in a single step to a receiving sheet S that is electrostatically fixed to a surface 34A of a transport belt 34 by a corona charger 39*a*. The transport belt 34 is trained about rollers 36 and 37. Details regarding the transport belt 34 are provided in WO 98/04961. The transfers described in this embodiment are electrostatic and no elevated temperatures are provided to cause the toner to soften to facilitate transfer. The receiver sheet S passes through the nip 30 formed by the ITM drum 20 and a transfer backup roller 33. The multicolored image is transferred by applying a sufficient electrical potential, for example, 2000 volts applied by a power source 29 to transfer backup roller 33. The transport belt 34 is moved out of engagement with the ITM 20 while the multicolor image is being formed on the ITM. The transport belt has about a 6 mm wrap about the ITM at the nip area 30 when transferring the multicolor toner image on the ITM to the received sheet.

Once the image is transferred to the receiver, the transport belt delivers the receiver sheet to a fixing device, for example, a tack down fuser 56 where heat and pressure are provided to fix the toner image to the receiver sheet. The receiver sheet is released from the transport belt 34 by means of a detack corona charger 39.

A cleaning brush or blade 19 removes untransferred toner remaining on the surface 13 of drum 11. Similarly, a brush or blade 17 is used to clean ITM 20 before reuse. The brush 17 is moved away from engagement with the ITM during formation of the multicolor image on the ITM. To facilitate removal of untransferred toner by brush 17 a preclean charge may be deposited on the surface of drum 20 by charger 50 to reduce adhesion of untransferred toner to ITM drum 20.

An alternative method to forming a multicolored image is to have individual electrostatographic modules for each colored toner. Separate images corresponding to each color would be written, toned, and transferred to the intermediate at the appropriate module, subsequently, transferred sequentially, in register, to the receiver. An example of such an alternative method is described in WO 98/04961 corresponding to U.S. application Ser. No. 08/900,696 the contents of which are incorporated herein by reference.

Turning now to the physics of adhesion, the adhesion of particles to a compliant substrate such as polyurethane is well described by the JKR theory of adhesion. According to that theory, the force$F_s$needed to remove a particle of radius R from a substrate is given by $$F_S = -\frac{3}{2} w_A \pi R \tag{1}$$

where $W_A$ is the thermodynamic work of adhesion and is related to the surface energies $\gamma_P$ and $\gamma_S$ of the particle and substrate, respectively, as well as their interfacial energy $\gamma_{ps}$ by $$W_A = \gamma_P + \gamma_S - \gamma_{PS}. \tag{2}$$

It is apparent from Eqn. 1 that the JKR theory predicts that the force needed to remove a particle from a substrate is independent of the Young's modulus of the substrate. Yet experimentally, the forces do depend on the moduli of the substrate. The role of the elastic modulus in controlling particle adhesion can be understood by recognizing that particles are not perfect spheres as required by the JKR theory. Rather, they have asperities, and as shown by Fuller and Tabor Proceedings Royal Society of London, Series A, Vol. 345, page 327 (1975), and more recently by Schaefer et al., Journal of Adhesion Science & Technology, Vol. 9, page 1049 (1995) the engulfment of the asperities into the substrate governs the removal force. Soft photoconductors impede transfer by promoting particle engulfment, as discussed by Mastrangelo, Photographic Science & Engineering Vol. 22, page 232 (1978). This effectively serves to diminish the beneficial effect of the silica. Accordingly, the amount of silica, which effectively serves as asperities on the surface of a toner particle, should significantly affect the size of the removal force, especially for photoconductors that do not show substantial particle engulfment. In principle then, the addition of silica should facilitate transfer. However, as previously shown, the addition of submicrometer addenda can also enhance dot explosion. Indeed, dot explosion can occur whether due to the reduced adhesion permitting toner particles to transfer in the pre-nip region or simply to a decrease in the interparticle cohesiveness. However, it is conceivable that, in the case of compliant intermediates, the toner particles would be embedded to such a depth into the intermediate that the silica would be of little benefit and, by effectively increasing the contact area, may actually impede transfer.

In the course of considering the problem of transfer using compliant intermediates several issues were addressed by the inventors. These issues are:

1. Is the use of particulate addenda really necessary when combined with a compliant intermediate transfer member?
2. Does the addition of particulate addenda actually affect transfer efficiency?
3. How does the amount of addenda to the toner affect image quality after transfer?
4. Does the addenda to the toner affect resolution or dot integrity when using a compliant intermediate?

In order to resolve these issues, various experiments were performed and are described in the following examples. This invention is directed to providing an optimal level of particulate addenda to be used for toner particles having diameters between 5 μm and 10 μm, preferably between 5 μm and 9 μm, when electrostatographic images, preferably electrophotographic images, are produced using an apparatus comprising a compliant transfer intermediate.

EXAMPLES 1 and 2.

In these examples, the transfer efficiency, dot structure, and resolution of electrostatically transferred images were determined for a series of nominal 8.5 μm volume averaged diameter ground toner particles. In addition, the force needed to remove the particles from a photoconductor was measured using a Beckman LM 70 ultracentrifuge.

Two series of toners were used. The first comprised toner particles formed using a ground polyester binder with between 0% and 2% Aerosil R972 (produced by DeGussa, Inc.) silica particles, by weight, added to the surface of the toner particles. These silica particles tend to form as clusters or agglomerates of silica particles that adhere to the surfaces of the toner particles. The silica particles have an average diameter, as reported by DeGussa, of approximately 16 nm (nanometers) and SEM micrographs show agglomerate diameters in the range of 60 nm. The agglomerates or clusters of silica particles may be expected to have average agglomerate diameters between 5 nm and 100 nm. To determine an average agglomerate diameter a scanning electronmicrograph, preferably using a field emission SEM at a magnification sufficient to resolve several clusters is made. From the electronmicrograph an average diameter of each addenda cluster is made; i.e. diameters of the cluster in say three different directions are taken and averaged. The average of the average diameters of at least 10 clusters is then taken to calculate an average agglomerate diameter. The second series of experiments was quite similar except the toner particles also contained a silicone release agent level of 2 pph (parts per hundred by weight) which is determined by the weight of silicone to each 100 grams of polymer binder used in the formulation of the toner particles. The silicone is blended into the polymer matrix of each toner particle. The mean volume-weighted average diameter of the toner particles, was approximately 8.6 μm for the toner without the silicone additive and approximately 8.1 μm for the silicone-containing toner. Reference herein to toner particle size or diameter, unless otherwise indicated, means the mean volume weighted diameter as measured by conventional diameter measuring devices, such as a Coulter Multisizer, sold by Coulter, Inc. Mean volume weighted (MVW) diameter is the sum of the products of the mass of each particle times the diameter of a spherical particle of equal mass and density, divided by total particle mass. The measurement of MVW diameter of the toner particles is made before placement of the toner in the development apparatus.

An electrophotographic developer was made by mixing the toner with a carrier comprising hard ferrite particles. The carrier particles had a volume-weighted diameter of approximately 30 μm. The toner charge was determined using an apparatus containing two planar electrodes spaced approximately 1 cm apart. Approximately 0.1 g of developer was deposited on the lower one of the two electrodes. The lower electrode was located above, but in close proximity to, a donut-shaped segmented series of magnets with alternating polarity. An electrometer was connected to the upper electrode of the two electrodes. The electrodes were biased in such a manner as to attract the toner to the upper electrode as the magnets rotated, thereby simulating electrophotographic development. After all the toner was stripped from the developer, the charge on the upper electrode was determined and the mass of the toner giving rise to that charge was measured. This technique is more fully described elsewhere. The toner charge-to-mass ratio was found to be approximately 37±3 μC/g for each of the toners.

Twelve grams of developer were loaded into a sumpless development station comprising a rotating core of alternating pole magnets and a concentric stainless steel shell. This type of station was chosen because it allowed small amounts of developer to be used and avoided variations in the toner concentration and charge-to-mass ratio associated with larger, more conventional stations. Development was performed using the so-called "SPD" technique, as discussed by Miskinis in Proc. Sixth International Congress on Advances in Non-impact Printing Technologies, IS&T, 1990, pages 101–110. The "SPD" technique employs carrier particles that are of coercivity greater than 200 oersteds. A commercially available organic photoconductor was initially charged to a predetermined potential using a grid-controlled DC corona charger and an electrostatic latent image formed by contact-exposing the photoconductor using a test target. The test target contained a series of continuous-tone neutral density steps, a 150-line rule 30% dot halftone pattern, and a resolution chart. The photoconductor was then passed over the development station where toner was deposited on the photoconductor in an image-wise fashion. The toner image was electrostatically transferred to a biased compliant transfer intermediate roller having a resistivity of the order of $10^9$ ohm-cm. The Young's modulus of the compliant intermediate's blanket layer was 3.82 MPa (megaPascals) with a blanket thickness of approximately 5 mm. The compliant intermediate transfer roller or drum had a 5 μm Permuthane (trademark of Stahl Finish) overcoat with a Young's modulus greater than $10^8$ Pa.

The speed of the photoconductor during the transfer process was approximately 2.5 cm/s. The width of the transfer nip formed between the intermediate transfer roller and the photoconductor (in the direction of movement of the photoconductor) was approximately 6 mm. Transfer voltages ranged between 500 and 2,500 volts. It was found that the transfer efficiency of the second transfer (from the intermediate transfer roller to the receiver) was very high (close to unity). Therefore, only the efficiencies of the first transfer are shown herein. Resolution and dot structure was measured on the photoconductor prior to transfer and on the receiver after both transfers. Resolution of the image was very good on the photoconductor and was better than the limitations of the scale used (16 line pairs/mm). Similarly, dots on the photoconductor were quite circular with minimal numbers of toner satellites. Any measurable artifacts in the final images occurred during the transfer steps.

Transfer efficiency was measured using transmission densitometry for toned optical densities on the photoconductor between 0.1 and 1.0. The receiver was Potlatch Vintage Gloss paper. The average transmission efficiency over the range of optical densities was determined as a function of voltage applied to the transfer roller. The conducting layer of the photoconductor was grounded and the maximum transfer voltage applied was 2500 volts. The transfer efficiency increased with applied transfer voltage over the entire 500–2500 volt range. The voltage, $V_{90\%}$, at which the average transfer efficiency exceeded 90% was then determined for each series of toners containing the various levels of silica mentioned above. In addition the average transfer efficiency over both the range of toned optical densities and the range of voltages between $V_{80\%}$ and 2500 volts was also determined. This averaging procedure was carried out using numerical integration of polynomial curves fit to the data over the aforementioned range. This method of averaging provides a measure of the "robustness" of the toner to transfer variations. Finally, the resolution and dot integrity were determined both before and after transfer at an applied transfer voltage of 1500 volts. Each of these measurements was performed with and without the addition of a silicone release agent to the toner to promote release from the photoconductor.

The adhesion of the toner particles to the photoconductor was determined by developing low density patches and removing the toner in an ultracentrifuge capable of spinning at 70,000 rpm. The procedure is as follows. The initial number of particles on the photoconductor was established by counting, using a high powered microscope with CCD camera and suitable image analysis software. Next, the photoconductor was placed in the centrifuge and spun at the desired speed. The sample was then removed and the remaining particles on the photoconductor were counted. This process was repeated for a series of speeds. Centrifugation was performed in a low vacuum of approximately $10^{-3}$ torr. The initial coverage was 0.5 density as measured in transmission corresponding to a 50–60% surface coverage by the particles.

EXAMPLES 3–6.

Experiments were performed to investigate the effects of toner size distribution on transfer efficiency. A series of surface treatment concentrations were applied to samples of toner particles having different toner size distributions such that coverages of the surface treatment were identical in each sample. The toner particle sizes of the samples investigated were 5, 6.2, 7, 8.2 $\mu$m in diameter. Transfer experiments were again performed using the compliant intermediate member as in examples 1 and 2. In all cases, transfer efficiency from the photoconductive member to the compliant intermediate transfer roller improved up to 14% with increasing amounts of surface treatment. The surface treatments applied to the toner samples or different size distributions tended to diminish the resolution as compared to untreated toner. The resolution, however was at an acceptable level (greater than 8 lines/mm) for surface treatments of less than 0.7% by weight normalized to 8 $\mu$m toner diameter. Thus, the results of the size distribution study with varying levels of surface treatment concentrations were consistent with earlier experiments involving only 8 $\mu$m diameter toner.

Figure 2:
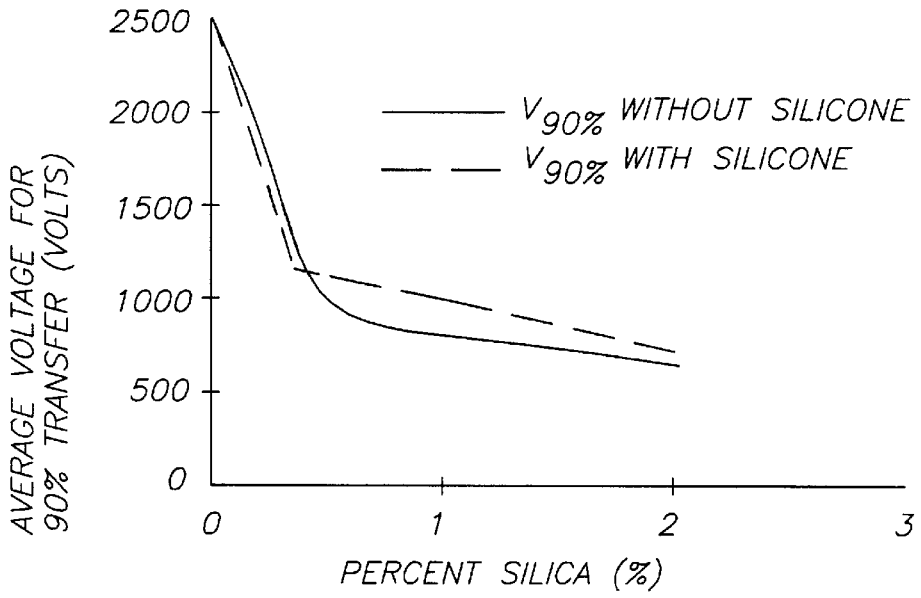
FIG. 2 is a graph illustrating the relationship of average voltage for 90% transfer vs. % silica addenda with and without silicone release agent.

The applied voltage, $V_{90}$%, for which the efficiency of the first transfer exceeds 90%, as a function of silica concentration, is shown in FIG. 2 for the toners with and without the silicone additive. As can be seen, the voltage necessary for 90% transfer drops rapidly with increasing silica concentration for both toners. However, the effect levels off for silica concentrations of more than 0.5% with the effect for 1 % and 2% silica only incrementally larger than that at 0.5%. Moreover, it can be seen that the use of a toner having a silicone additive in conjunction with silica concentrations greater than 0.5% not only does not result in a further reduction in the voltage needed for 90% transfer but actually shows somewhat reduced transfer benefits compared to a toner sample having a silica treatment applied but without the silicone additive. Surprisingly, the silicone additive may be acting as a liquid bridge that actually reduces the efficiency of the silica in separating the toner from the photoconductive surface. However, the use of a silicone additive still is desirable to reduce formation of scum on the image bearing surfaces of the apparatus.

Figure 3:
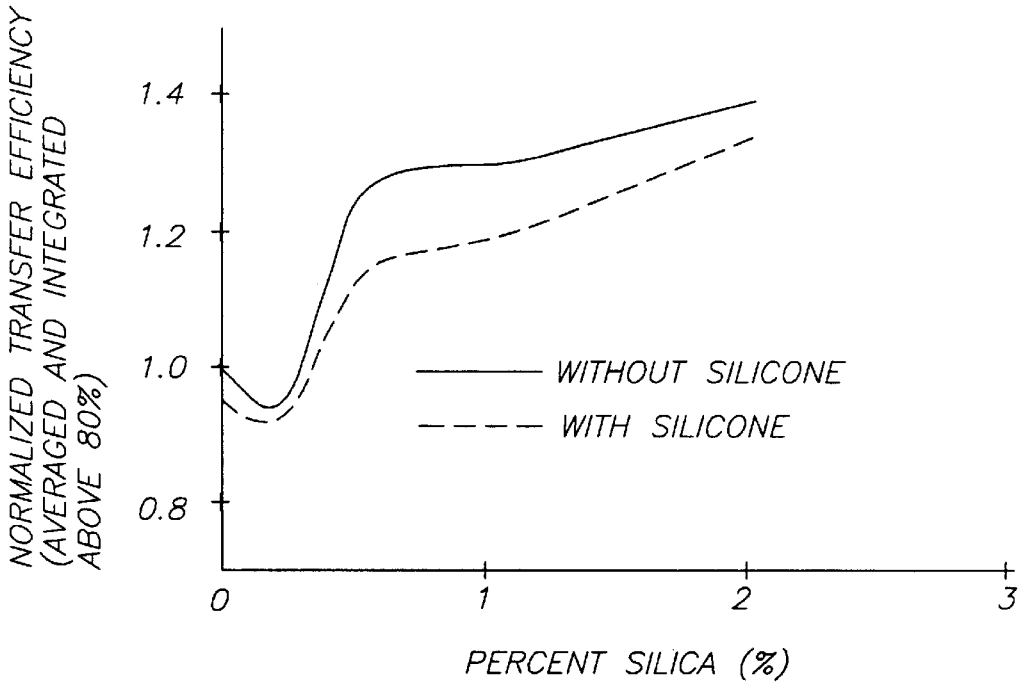
FIG. 3 are graphs illustrating the relationship of normalized density averaged transfer efficiency integrated over voltage from the voltage needed for 80% transfer to the upper bound of 2500 volts with and without silicone release agent as a function of silica content. Normalization is with respect to the integrated density averaged transfer efficiency for the toner without silica addenda and without silicone release agent.

FIG. 3 shows the integrated averaged transfer efficiency above 80% for each of the two silica-treated toner series, normalized to the performance of the toner without silica or silicone additive. Solid symbols show the results without silicone additive while open symbols show the results when silicone additive is present. The integrated averaged transfer efficiency is determined by first averaging the measured transfer efficiency over a range of 10 density steps from 0.1 to 1.0 for each voltage from 0 to 2500 volts in steps of about 200 volts. A smooth curve is then fit to the average transfer efficiency as a function of voltage and this curve is integrated from the lowest voltage that produces an 80% average transfer efficiency to the maximum voltage examined, 2500 volts. In this way, systems with a narrow transfer efficiency window vs. applied transfer voltage will show a lower voltage integrated average and can be distinguished from more robust systems showing a broad maximum. It can be seen from FIG. 3 that the integrated average transfer efficiency, a measure of transfer robustness, despite an initial decrease, generally improves with increasing silica concentration, but at a decreasing rate once the silica concentration exceeds 0.5% by weight of toner. These results are consistent with the voltage results shown in FIG. 2. Also in agreement with FIG. 2, the data shows that the presence of the silicone additive reduced the integrated average transfer for all conditions.

From the data thus far presented, it may appear that the process of transferring toner can be made more robust, although perhaps reaching a point of diminishing returns, simply by increasing the concentration of silica on the toner particles. However, this is not quite correct. Transfer is not just the removal of toner from a photoconductor accompanied by a deposition of the toner on a receiver. Rather, it is that process with the additional constraint that image disruption must be minimized. Image disruption was characterized by microscopically examining the halftone dot pattern and resolution chart before and after transfer.

Figure 4A:
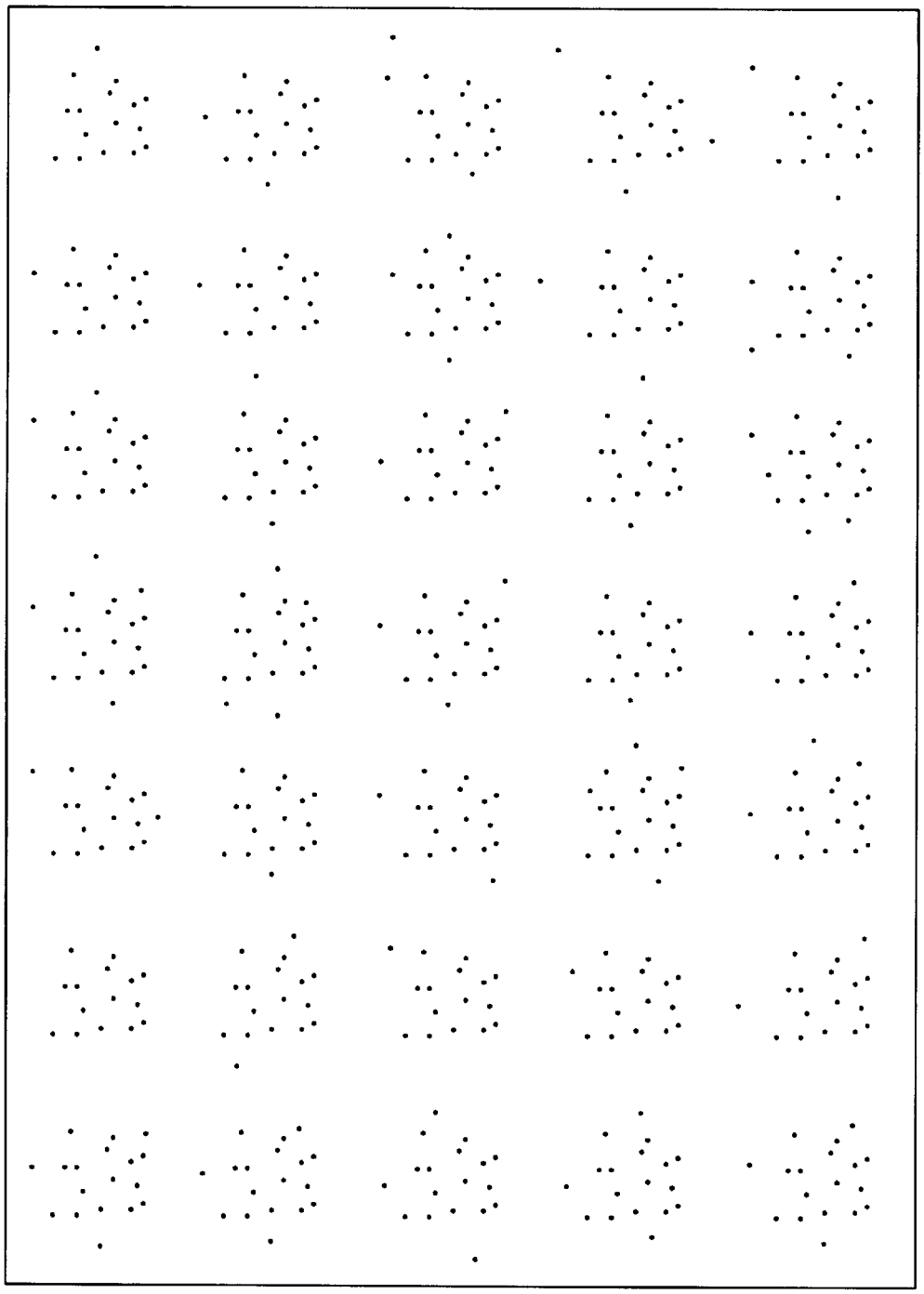
FIGS. 4A, B, & C are electronmicrographs illustrating respectively halftone dot patterns after transfer for a silicone-containing toner with 0%, 0.5%, and 2.0% silica, obtained using a 150 line rule. (i.e. 150 lines per inch.)
Figure 4B:
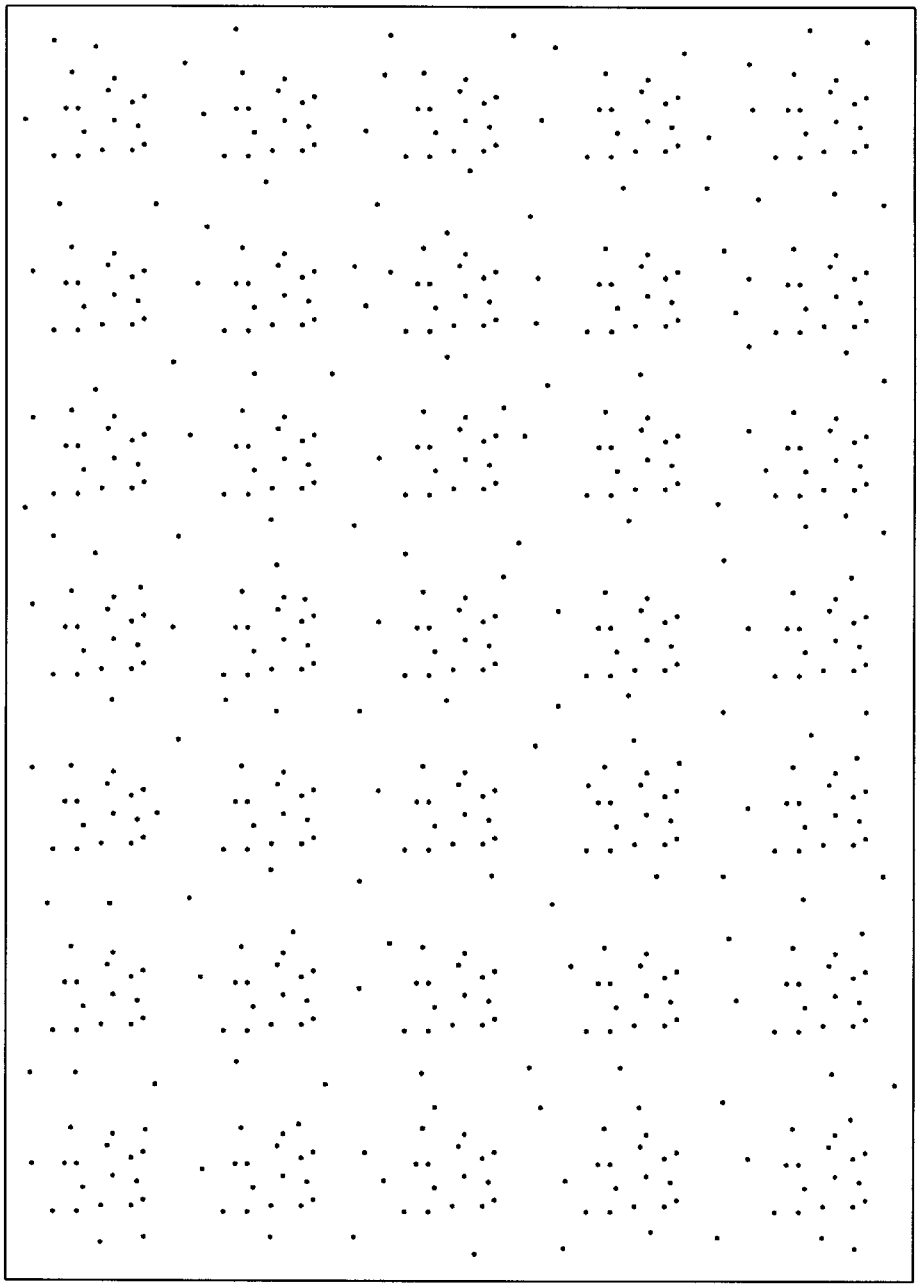
Figure 4C:
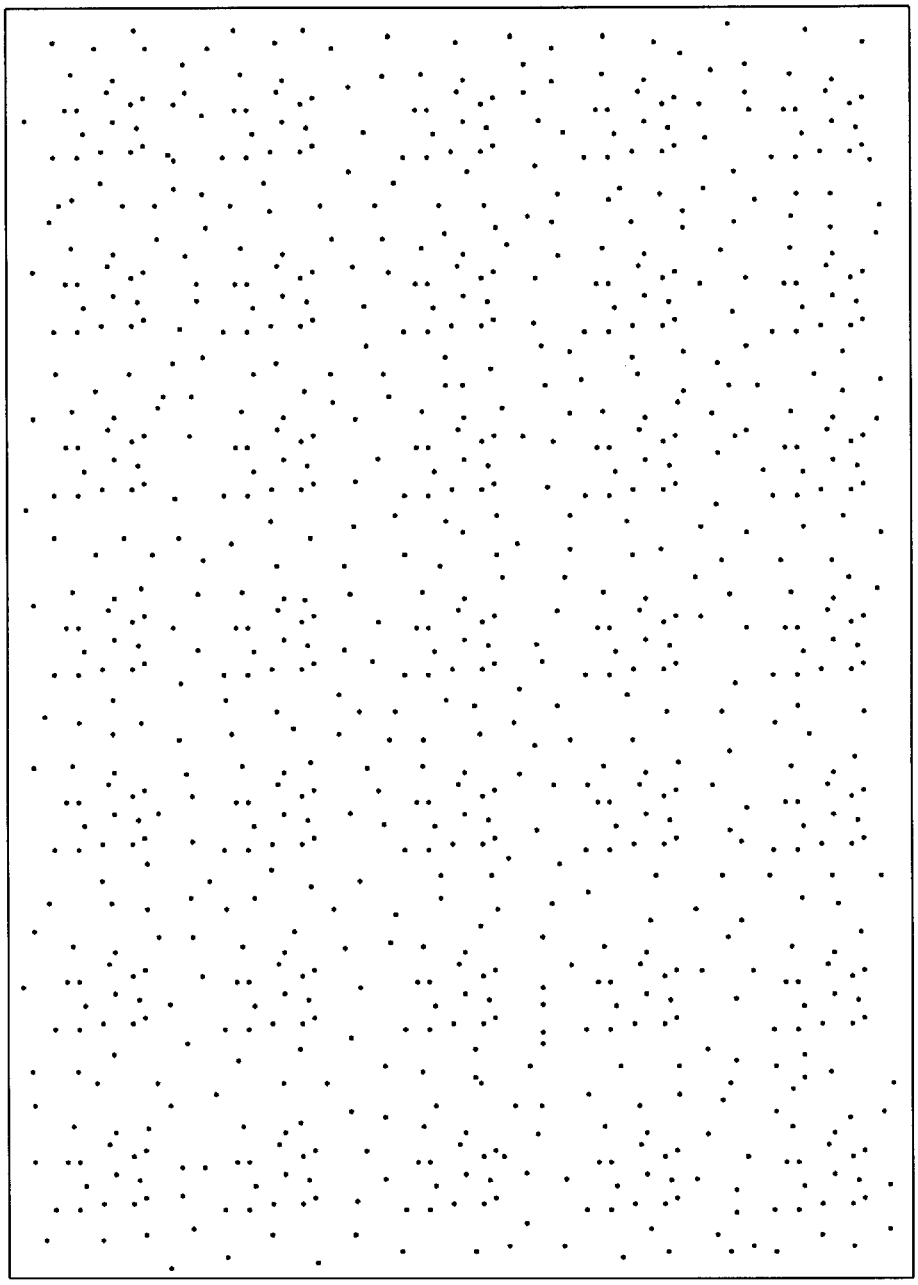
Figure 5:
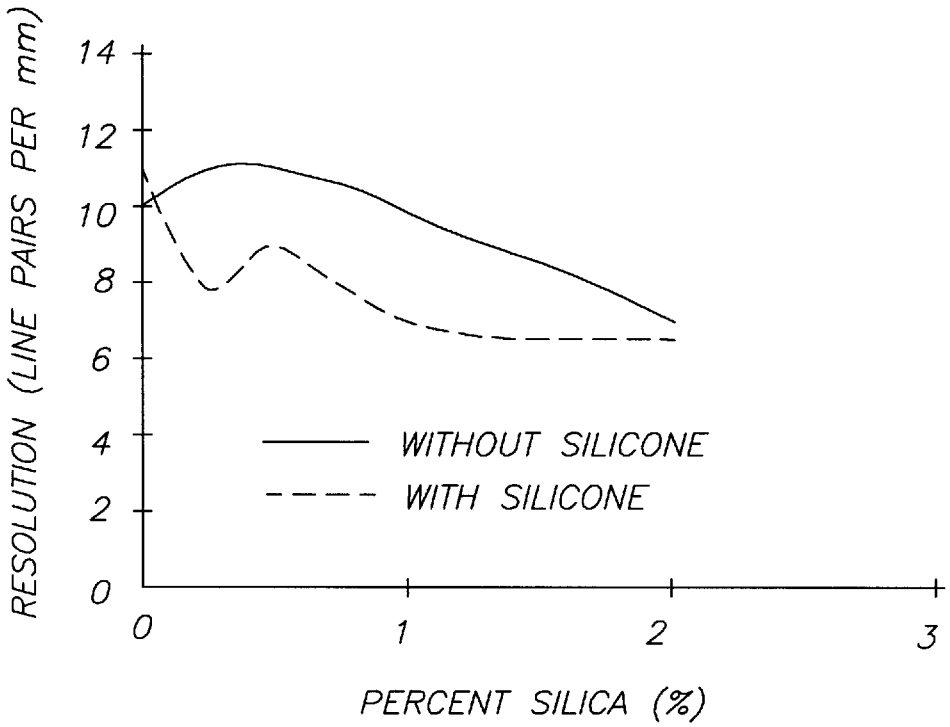
FIG. 5 are graphs illustrating the relationship of resolution as a function of silica concentration for the toner with and without silicone adhesion additive.

The effect of the silica concentration on image disruption was determined by qualitatively examining the structure of the halftone dots and measuring the resolution in line pairs per millimeter before and after transferring the image using a 1500 volt transfer bias. Before transfer, a resolution between 14 and 16 line pairs per millimeter was obtained. Moreover, the dots were well formed, exhibited minimal satellite formation, and, in general, appeared to accurately reproduce the test target. However, it was found that after transfer using a compliant intermediate transfer member, the dots were disrupted, with the amount of disruption and the number of satellites increasing monotonically with increasing silica concentration. This effect is shown in FIGS. 4A–4C for the silicone-containing toner with 0, 0.5, and 2.0% silica, respectively. As can be seen in FIG. 4A, in the absence of silica, the halftone dots are still fairly well formed after transfer, although disruption and the presence of satellite toner particles are obvious. Increasing the amount of silica to 0.5% clearly resulted in significantly more dot disruption and satellite formation, as shown in FIG. 4B. Upon further increasing the amount of silica to 2.0%, the dot structure has been nearly obliterated by disruption of the dots during transfer, as illustrated by FIG. 4C. Resolution also tends to decrease with increasing silica concentration. This effect is shown in FIG. 5, for toners both without and with the silicone additive. The reduction in resolution is more severe for the toner system containing the silicone release agent.

Figure 6:
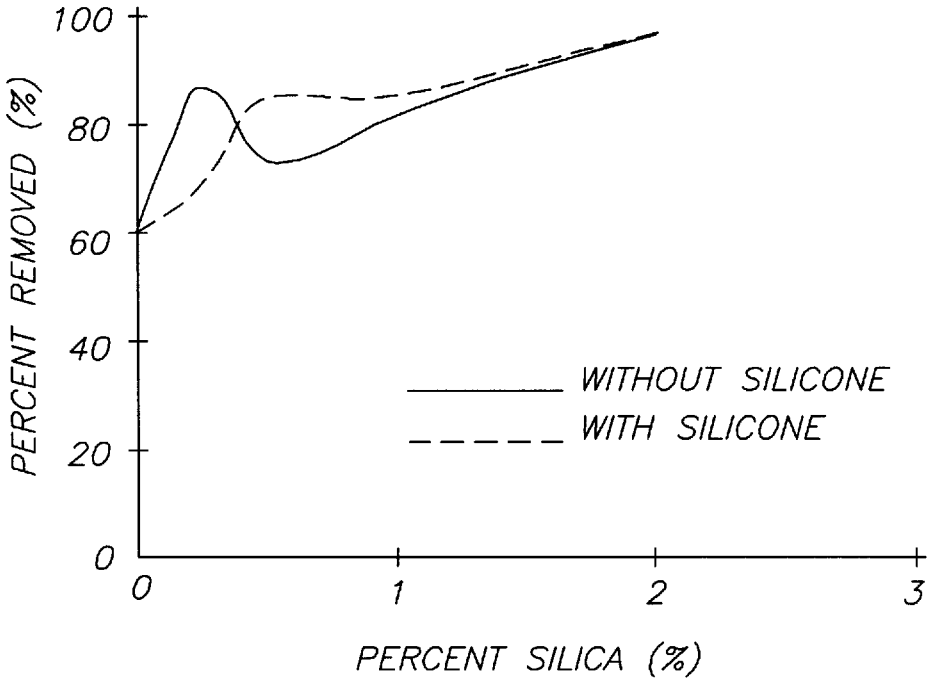
FIG. 6 are graphs illustrating percent of toner removed from the photoconductor at 70,000 rpm as a function of silica concentration, with and without silicone adhesion additive.

As indicated earlier, an ultracentrifuge was used to characterize the toner-to-photoconductor adhesion as a function of the weight percentage of silica. FIG. 6 shows the percentages of toner, with silicone (open circles) and without silicone (solid circles), that were removed from the photoconductor at 70,000 rpm for the five levels of toner with silica examined. With the exception of an initial increase at 0.25% silica, the percent removed increases monotonically with increasing silica content, asymptotically approaching 100% removal at or around 2% silica by weight. The initial increase at 0.25% silica is viewed as an anomalous point that is correlated with the atypically smooth surface morphology of this particular toner mixture when examined by scanning electron microscopy (SEM). The presence of silicone in the toner mixtures showed no further reduction in the adhesion force, even in the absence of the silica. These results suggest that while the presence of silica significantly reduces the adhesion forces, the presence of silicone does not. The behavior of the toner-silica mixtures determined by mechanical measurements in the ultracentrifuge are essentially unchanged by the presence of silicone in contrast with the systematic changes in the adhesion behavior inferred from the transfer measurements mentioned earlier.

Figure 7:
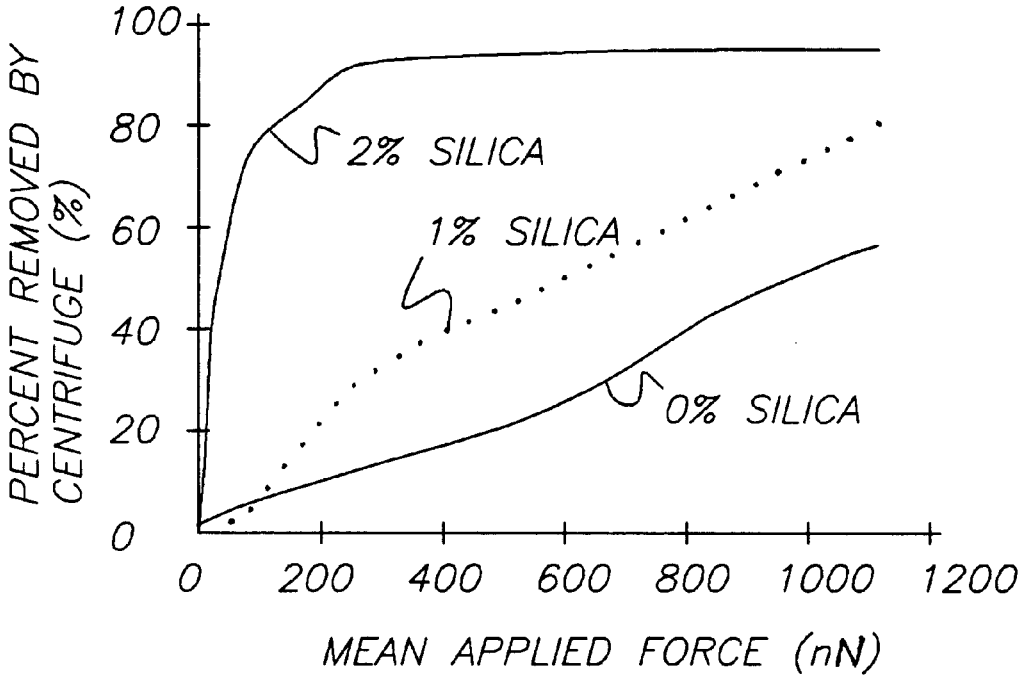
FIG. 7 are graphs illustrating percent of toner removed by centrifuge as a function of removal force for three levels of silica: 0%, 1%, and 2%, for toner without silicone adhesion additive.

FIG. 7 shows the percent of the toner (without silicone) removed from the photoconductor as a function of the mean applied force in nanonewtons (nN) produced by different centrifuge speeds. Data for three silica concentrations of 0%, 1 %, and 2% are shown. The highest force corresponds to 70,000 rpm so that the end points of the curves in FIG. 7 are the $1^{st}$, $3^{rd}$, and $5^{th}$ data points from FIG. 6. As can be seen, the general shapes of the curves gradually change for increases in silica concentration. Without silica, the percent removed is nearly linear with the mean applied force over the range investigated. There is no tendency to reach an asymptote. With 2% silica, the curve rises steeply and then curves to asymptotically approach 100% particle removal as the mean applied force is increased. The result for 1% silica is intermediate following the 0% result initially and then rising as the centrifugation speed and hence mean force is increased. Because there is a distribution in toner sizes in each toner sample, the larger particles would be removed first. If 1% is insufficient to coat all the particles completely, this could be a rationalization of the behavior observed for 1% silica.

The mean applied forces reported above were calculated by assuming that the particles were spherical polyester toner with a radius of 4 $\mu$m and a mass density of 1.2 g/cm$^3$. The removal force, $P_s$, estimated at the 50% removal point, was determined to be 970 nN, 580 nN, and 39 nN for the 0%, 1%, and 2% silica-coated toner particles, respectively.

As shown above, transfer efficiency improves with increasing silica concentration while dot integrity and resolution are both degraded. Moreover, the force needed to detach the toner from the photoconductor also decreases with increasing silica concentration.

The observed losses in dot integrity and resolution can also be explained in terms of decreasing cohesion. As discussed previously, the highly charged toner particles would tend to repel one another rather than exist as a coherent mass, as in a dot or alpha-numeric character. However, at short ranges, i.e. less than 30 nm (nanometers), the attractive van der Waals forces dominate over the Coulombic repulsion stabilizing the images during transfer. While offering beneficial effects for transfer by reducing the toner-to-photoconductor adhesion, the presence of the nanometer-size silica particles reduces the interparticle cohesion as well, thereby increasing the propensity for clusters of toner particles comprising the images to fly apart during transfer. Indeed, increases in toner cohesion with aging, attributed to the silica being engulfed by the toner particles and thereby losing their spacer effect, was reported by M. L. Ott, Proc. $19^{th}$ Annual Meeting of the Adhesion Society, T. C. Ward (editor) Adhesion Society, Blacksburg, Va., 1996 pp 70–73.

Thus, it is found that the transfer efficiency of an electrostatographic toner increases with an increasing concentration of nanometersize silica particles on the surface of the toner. However, accompanying the improved transfer efficiency is a loss of resolution and a decrease in dot integrity. These results track with a decrease in the adhesion of the toner to the photoconductor, as measured with an ultracentrifuge. The size of the removal forces measured appear consistent with estimates that assume van der Waals interactions, but, in general, appear too large to be attributed to electrostatic interactions alone. As the concentration of silica approaches2%, the contributions of the van der Waals and the electrostatic forces become comparable in magnitude.

The optimal level of particulate addenda appended to the surface of a toner particle is determined by the desire to enhance transfer efficiency while maintaining image structure. Specifically, by decreasing the forces of adhesion holding toner particles to an image-bearing member, transfer efficiency can be improved. Associated with improved transfer efficiency are such image quality related improvements as reduced mottle, less halo (the failure to transfer toner adjacent to a high density region or alpha-numeric from the image-bearing member), and better maintenance of color balance across the desired density range. On the other hand, by reducing the toner to image-bearing member adhesion by the addition of third component particulate addenda, one also reduces toner particle cohesion. The highly charged toner particles tend to repel each other, resulting in disruption of the image, as manifested by the gain in half-tone dots, the occurrence of toner satellites adjacent to toned areas, loss of resolution, and increased granularity. Moreover, the decrease in the toner to image-bearing member adhesion also allows the toner particles to more readily follow the field lines in the transfer region. As the adhesion is reduced, transfer can occur with weaker, more divergent, fields as occur in the pre-nip region, thereby further aggravating the formation of satellites and loss of resolution. It is clear that, in order to optimize image quality, one must find a concentration of third component particulate toner addenda that balances the conflicting demands of these criteria.

The situation is made more complicated because toner properties such as adhesion forces and toner charge depend on the toner size. Moreover, the presence of third-component particular addenda further complicates the relationship between these properties and the toner particles. The optimal concentration of third-component particular addenda depends, accordingly, on the size of the toner particles.

The optimal concentration of third component addenda was determined for a variety of toner particles having diameters between about 5 $\mu$m and about 10 $\mu$m. For example, FIGS. 2 and 3 show respectively the voltage at which the transfer efficiency exceeds 90% and the normalized transfer efficiency as a function of third-component particulate addenda concentration for an 8 $\mu$m diameter toner. As can be seen, both of these parameters improve with increasing silica concentration, although at a slower rate when the concentration exceeds about 0.7%, corresponding to a concentration value of 5.6/D percent, as normalized to the diameter of the toner. Conversely, when the concentration of third-component particulate addenda is less than approximately 0.4% for this same toner, corresponding to a size normalized value of 3.2/D percent, transfer efficiency is not significantly improved over the 0% addenda case. However, as shown in the figures illustrating dot structure (FIGS. 4A–4C) dot structure is degraded with increasing third-component particulate addenda concentration. Moreover, as illustrated in FIG. 5, resolution decreases for particulate addenda concentrations greater than 0.7%. Therefore the optimal concentration in percent by weight for effective transfer with minimal image degradation with a compliant transfer intermediate, normalized for toner particle size, was experimentally found to lie between 3.2/D and 5.6/D, where the toner particle diameter D is measured in micrometers and determined using the mean volume weighted diameter of the toner particles input to the development station.

In the above description concentration of particulate addenda is the percent ratio of weight of particulate addenda to gross weight of toner particles including the particulate addenda. Other particulate addenda may be used in lieu of silica for example strontium titanate, barium titanate, latex particles, etc. The toner particles are each formed of a blended matrix of various substances including polymer binder, charge control agent(s), pigment and optionally in the above examples, silicone. As is well known after the toner particles are formed with each particle having the polymer binder, pigment and optionally silicone blended as a matrix therein, the particulate addenda is added to the toner particles and mixed therewith and forms addenda clusters on the surfaces of each of the pigmented toner particles.

In its broader aspects it is not essential in the invention that the primary image forming member be a photoconductor. It can be any surface that supports a toner image for transfer to a compliant intermediate transfer member. The silicone additive noted above is a multiphase polyorganosiloxane block or graft condensation copolymer that is blended with the binder resin of the toner which provides polyorganosiloxane domains having a maximum diameter of from about 10 to 3000 nm.

The silicone additive is comprised of from about 10 to about 80 weight percent of the polyorganosiloxane segment, which can be a polydimethyl siloxane. The condensation segment can be a polyester, polyurethane, or a polyether. The additive is used at from about 0.5% to about 12% of the binder resin. More detailed descriptions of this additive is provided in U.S. Pat. No. 4,758,491, the pertinent contents of which are incorporated herein by reference. The specific additive material used in the experiments described above is a condensation product of azelaic acid chloride, bisphenol A and 40 weight percent of a bis(aminopropyl) terminated polydimethyl siloxane polymer.

There has thus been described an improved method of producing images wherein optimazation of transfer efficiency is realized with minimal disruption of the transferred toner image.

The invention has been described in detail with particular reference to preferred embodiments thereof, but it will be understood that variations and modifications can be effected within the spirit and scope of the invention.

What is claimed is:

1. A method of producing images comprising:

forming an electrostatic latent image on a primary image forming member;

forming a toner image on the primary image forming member by developing the electrostatic latent image using a developer comprising dry toner particles having a mean volume weighted diameter D between 5 $\mu$m and 10 $\mu$m, the toner particles containing particulate addenda in a concentration range between (3.2/D)% and (5.6/D)%;

electrostatically transferring the toner image from the primary image forming member to an intermediate transfer member having a compliant layer; and electrostatically transferring the toner image from the intermediate transfer member to a receiver.

2. The method of to claim 1 wherein the primary image forming member is a photoconductor and the electrostatic latent image is formed electrophotographically.

3. The method of claim 1 wherein separate electrostatic latent images corresponding to different colors are developed with separate development stations containing dry developer comprising toner particles having a size range between 5 and 9 micrometers and having particulate addenda in the concentration range (3.2/D)% and (5.6/D)%.

4. The method of claim 1 wherein the particulate addenda are substantially smaller than the toner particles and adhere to the surfaces of the toner particles.

5. The method of claim 4 wherein the particulate addenda are silica particles.

6. The method of claim 2 wherein the particulate addenda are substantially smaller than the toner particles and are on the surfaces of the toner particles.

7. The method of claim 6 wherein the particulate addenda are silica particles.

8. The method of claim 1 wherein the compliant layer has a Young's modulus in the range of about 0.1 MPa to about 10 MPa.

9. The method of claim 8 wherein the particulate addenda are silica.

10. The method of claim 1 wherein the compliant layer has a Young's modulus in the range of 1 MPa to 5 MPa.

11. The method of claim 1 wherein the particulate addenda are silica.

12. The method of claim 1 wherein the mean volume weighted diameter D of the toner particles is between 5 $\mu$m and 9 $\mu$m.

13. The method of claim 1 wherein the toner particles include a binder resin and blended therewith as an additive a multiphase polyorganosiloxane block or graft condensation copolymer.

14. The method of claim 1 wherein the toner image is a halftone image.

15. A method of producing images comprising:

forming on a primary image forming member a toner image with dry toner particles having a mean volume weighted diameter D between 5 $\mu$m and 10 $\mu$m , the toner particles containing particulate addenda in a concentration range between (3.2/D)% and (5.6/D)%;

electrostatically transferring the toner image from the primary image forming member to an intermediate transfer member having a compliant layer; and electrostatically transferring the toner image from the intermediate transfer member to a receiver.

16. The method of claim 15 wherein the particulate addenda are substantially smaller than the toner particles and are on the surfaces of the toner particles.

17. The method of claim 16 wherein the particulate addenda are silica particles.

18. The method of claim 15 wherein the compliant layer has a Young's modulus in the range of about 0.1 MPa to about 10 MPa.

19. The method of claim 15 wherein the mean volume weighted diameter D of the toner particles is between 5 $\mu$m and 9 $\mu$m.

20. The method of claim 15 wherein the toner particles include a binder resin and blended therewith as an additive a multiphase polyorganosiloxane block or graft condensation copolymer.

21. The method of claim 15 wherein the toner image is a halftone image.

* * * * *